250-506.1 SR
OR 4,274,007
T250/506.1

United Stat[redacted]

4,274,007

Baatz et al.

Jun. 16, 1981

[54] RADIATION-SHIELDING TRANSPORT AND STORAGE VESSEL

[75] Inventors: Henning Baatz, Essen; Dieter Rittscher, Heiligenhaus, both of Fed. Rep. of Germany

[73] Assignee: GNS Gesellschaft für Nuklear-Service mbH, Essen, Fed. Rep. of Germany

[21] Appl. No.: 120,108

[22] Filed: Feb. 8, 1980

[30] Foreign Application Priority Data

Feb. 10, 1979 [DE] Fed. Rep. of Germany ..... 2905094

[51] Int. Cl.[3] ..... G21F 5/00
[52] U.S. Cl. ..... 250/506; 250/515
[58] Field of Search ..... 250/506, 507, 515

[56] References Cited

U.S. PATENT DOCUMENTS

| | | | |
|---|---|---|---|
| 3,845,315 | 10/1974 | Blum | 250/507 |
| 4,197,467 | 4/1980 | Williams | 250/506 |

*Primary Examiner*—Harold A. Dixon
*Attorney, Agent, or Firm*—Karl F. Ross

[57] ABSTRACT

A transport or storage canister for radioactive wastes has an upright one-piece cast iron or steel vessel with an upwardly open mouth adapted to receive a complementary, stepped plug-type cover which is overlain by a safety cover which peripherally overhangs the plug cover and is likewise recessed in the top of the body. Seals are provided between the several steps so that respective gaps or compartments are formed, the compartments communicating with a fitting in the body which enables monitoring or control units to be connected to the compartments to determine whether leakage may have occurred.

7 Claims, 4 Drawing Figures

RADIATION-SHIELDING TRANSPORT AND STORAGE VESSEL

CROSS REFERENCE TO RELATED APPLICATIONS

This application is related to our copending application Ser. No. 966,951, filed Dec. 6, 1978 and entitled "Radioactivity-Shielding Transport and Storage Receptacle for Radioactive Wastes".

The application is also related to the copending application Ser. No. 940,856, filed Sept. 8, 1978 and entitled "Transport-Storage Vessel for Radioactive Materials". The latter application makes reference to our application Ser. No. 940,098 (see also Ser. No. 107,276 filed Dec. 26, 1979).

The prior art best known to applicants is the art of record in said applications, which are included herein by reference in their entireties.

FIELD OF THE INVENTION

Our present invention relates to transport and storage vessels or canisters for nuclear materials, especially nuclear wastes such as irradiated or spent fuel elements for nuclear reactors and, more particularly, to an improved radiation-shielding transport or storage vessel.

BACKGROUND OF THE INVENTION

As will be apparent from our prior applications mentioned above and the developments in the transport and storage of nuclear wastes referred to by the art of record in these applications, it is recognized that the storage of radioactive materials, such as spent nuclear fuel rods or other materials, can be effected with canister receptacles or vessels, which are sealed after the nuclear waste is introduced and which have radiation-shielding properties as a result of the wall thickness of the vessel body and/or radiation absorbing characteristics of the material, from which the body is composed.

For example, the body may be made of a material having a high neutron cross section or materials with a high neutron cross section can be incorporated in the body. Alternatively, or in addition, passages or spaces may be formed in the body and gamma-ray or neutron absorptive or moderating materials can be introduced.

Obviously the vessel must have excellent structural integrity as well as a capacity to act as a radiation shielding material.

The canister basically comprises a chamber-forming body or receptacle, advantageously upwardly open, with a relatively thick vertical wall and a closed bottom and a cover for the upper end or mouth of the chamber.

The vertical walls are usually comprised in one piece with the bottom of cast iron, preferably spherolytic cast iron, or cast steel, while a recess is formed in the upper end of the body so that the cover structure can be recessed therein with a plug-like fit and an upper surface flush with the upper surface of the body.

The earlier systems also provided for sealing the cover to the body and even monitoring the state of the seal to ascertain whether any leakage may have occurred.

Such monitoring is relatively simple because, in addition to the radioactive materials filling the chamber, the latter receives a control gas blanket and any failure of the seal can be detected by monitoring the composition of this control gas or detecting the presence thereof.

It has also been noted that the cast iron or steel alloy can include radiation-absorbing alloying components and/or radiation-absorbing inclusions.

The term "radiation shielding" as used to describe a canister or vessel, thus defines a vessel whose thickness at any point (wall, cover or bottom) is sufficient to prevent escape of radiation, whether the radiation be of the gamma or neutron type and which also is able to withstand the mechanical stresses to which the vessel may be subjected in handling the in-transport or the like, both during normal manipulations and in the event of a disaster, such as a crash of a transporting vehicle.

The most general application utilizes flange-type covers which are bolted in place to the body, and it has been recognized that these systems may be problematic because the seal is maintained only as long as the bolts are tight or intact.

In transport accidents, however, the bolted flange receptacles run the risk of shearing or loosening of the bolts and release of radioactive materials into the environment.

Thus it is possible to "sniff out" a failure of the seal by monitoring the presence of the control gas outside of the edge of the cover and utilizing an appropriate gas detector or analyzer.

If a failure of the seal is observed, components of the radioactive waste or gaseous substances, which are formed by radioactive decay of the waste, can be found in the gas and may wander out of the receptacle.

Repair of the defective seam or seal is not a simple matter because removal of the cover can result in a serious contamination of the surrounding space by release of radioactive materials from the interior. The repair thus can only be carried out in a so-called hot-cell at considerable cost.

OBJECTS OF THE INVENTION

It is the principal object of the present invention to provide an improved radiation-shielding storage or transport container which allows more effective monitoring of the seal between the cover and the container body, and thereby prevents the escape of radioactive substances more reliably.

Another object of the invention is to provide a method whereby a defective seal in a device of the type described can be detected and repaired without the problems heretofore encountered.

It is another object of this invention to provide an improved transport vessel and sealing system for such vessel which simplifies mounting of the seal and repair without requiring a hot-cell or creating the danger of contamination in the event of an interruption of the seal.

SUMMARY OF THE INVENTION

These objects and others which will become apparent hereinafter are attained in accordance with the present invention in a system in which the plug-type cover is mounted in a stepped recess at the mouth of the container body and is overlain by a safety cover which peripherally overhangs the first-mentioned cover and is likewise recessed in the end of the container.

Sealing means is provided in gaps between the two covers and respective juxtaposed surfaces or seats formed by the recesses so that these seals are substantially complete peripherally, i.e. uninterrupted, and define them control spaces to which passages run and which can be connected by these passages to gas-monitoring devices responsive to the control gas.

The passages can be formed in the security cover, the plug-type cover and/or in the wall of the body as may be required and advantageously a plurality of such seals can be provided with each pair of spaced seals defining a respective control space between them.

In a preferred embodiment of the invention, the complementary portions of the plug-type cover and the recess in the body have an outward conical convergence, i.e. are slightly tapered downward and have a frustoconical configuration, a plurality of seals being provided axially (vertically) spaced between the frustoconical portions. This arrangement prevents damage to the seals upon insertion of the plug-type cover, especially when seals are carried by grooves in the plug-type cover.

According to another feature of the invention, the conical annular seals are O-rings, partially trapped in outwardly open circumferential grooves on the conical plug member of the cover.

According to yet another feature of the invention, the receptacle body is formed with an inwardly extending shoulder confronting the lower end of the plug member, while a further annular seal is provided between the shoulder and the end of the plug member. The container walls can be provided along the upper edge of the recess with a lip which lies along a lip of the cover so that the two can be selded together as described in application Ser. No. 966,951.

It is apparent that the system of the present invention has the advantage that a multiplicity of seals can be provided, thereby increasing reliability and safety. However, the control possibilities are also increased with this arrangement, for example, if it is assumed that a leakage past one of the seals is detected upon monitoring or analysis of the control gas by the gas detector, the safety cover can be simply removed and replaced with a fresh seal. Only a small amount of radioactive material can accumulate in any annular space between two seals so that the danger of large-scale contamination is excluded.

If the passage is so designed that the successive control spaces can be monitored individually, it is possible to evaluate the progress of seal failure and counter this by welding shut the container in the event one of the inner seals appears to develop a leak.

Furthermore, it is possible to seal the inner cover by welding and then replace the safety cover when the monitoring operation shows that one of the earlier seals in the path of the gas is beginning to leak.

BRIEF DESCRIPTION OF THE DRAWING

The above and other object features and advantages of the present invention will become more readily apparent from the following description, reference being made to the accompanying drawing in which.

SPECIFIC DESCRIPTION

Figure 1:
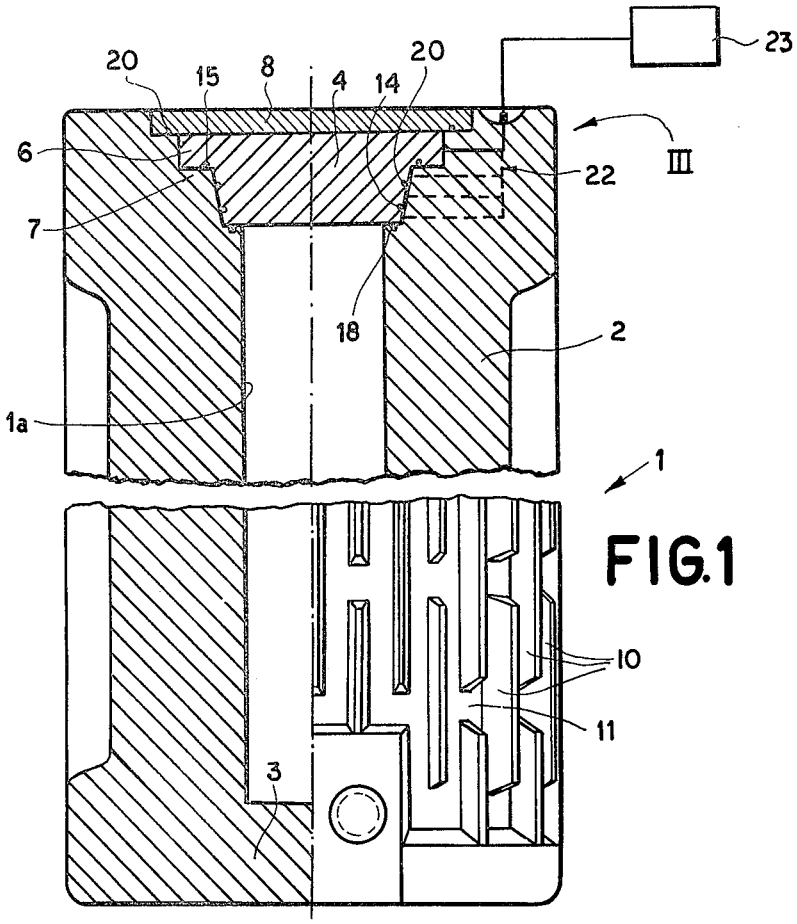
FIG. 1 is an elevational view partly in axial cross section of a radiation shielding transport and storage vessel according to the invention.

The radiation shielding transport and storage vessel 1 shown in the drawing is intended primarily to receive radioactive waste, especially nuclear-reactor fuel elements. The vessel comprises an upright wall structure 2 and a bottom 3 which is unitarily cast in one piece with the wall structure out of cast iron, especially spherolytic cast iron, cast steel or the like.

The container, which has a central cavity or chamber 1*a* to receive the radioactive material, is closed at its upper end with a shielding cover 4 of a plug configuration. The cover has a downwardly convergent frustoconical portion 5 which is received in a downwardly tapered recess.

Figure 2:
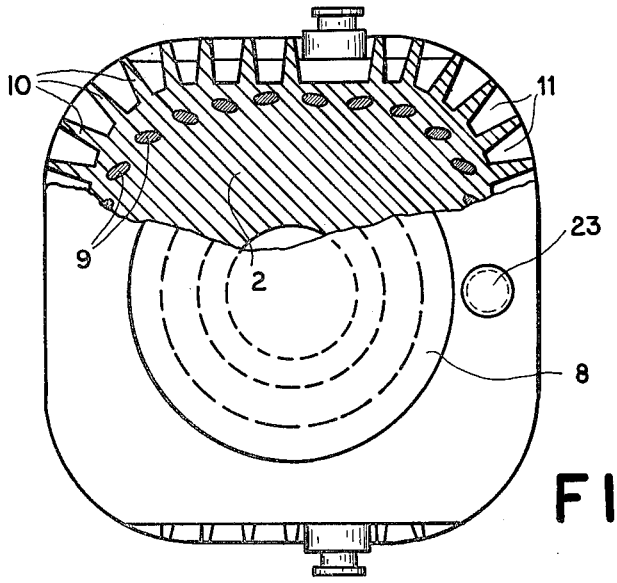
FIG. 2 is a plan view of the container partly broken away.

The outwardly extending flange 6 of the plug-like cover rests upon the shoulder 7 at the mouth of the vessel. As is especially clear from FIG. 2, in the outer regions of the vertical wall 2 passages 9 are provided and receive a moderating material which is designed especially to capture neutrons which may be emitted from the stored radioactive material. These passages 9, filled with water, heavy water, paraffin or the like, are closed by a safety cover 8 which can be bolted to the wall 2, outwardly of the passage 6, which it overhangs.

The wall 2 of the vessel is provided with unitary cast cooling or heat-dissipating ribs 10, as described in connection with applications 940,856 and 966,951, the ribs, having cut out or being erupted at 11 so that extension and contraction of individual rib sections is possible.

Figure 3:
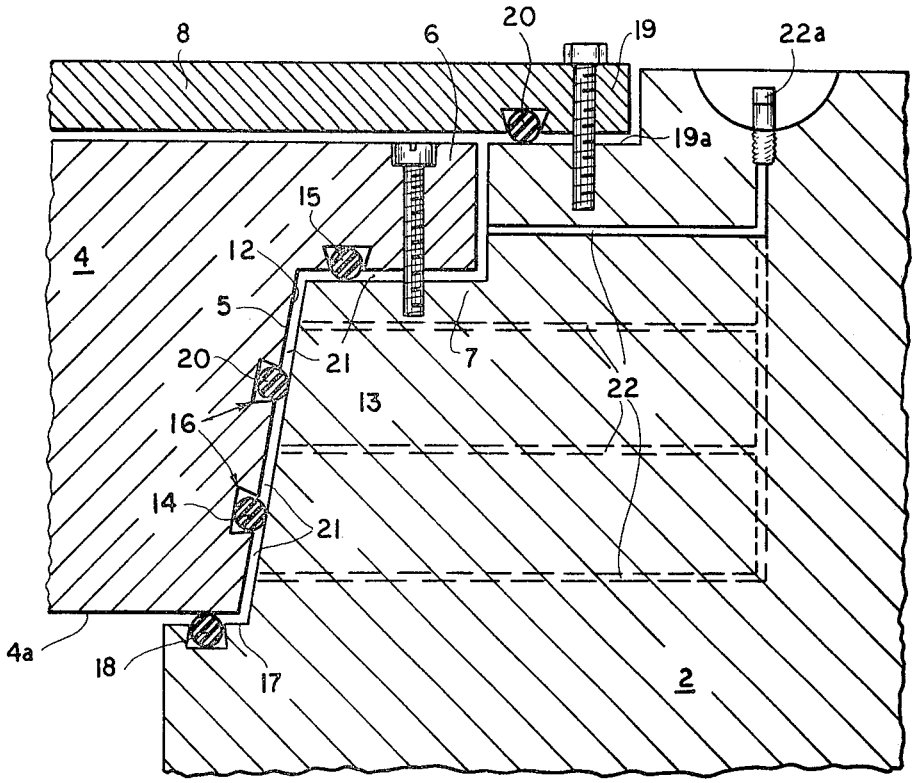
FIG. 3 is a detail view in section of the region shown at III in FIG. 1.
Figure 4:
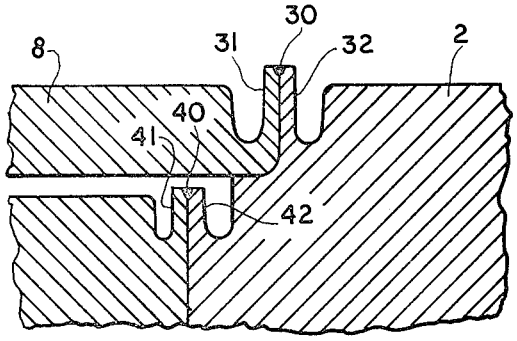
FIG. 4 is a detail view illustrating another aspect of the invention.

Between the conical surface of the plug portion 5 and the conical face of the surrounding recess 13, sealing rings 14 and 15 are provided. Each of these sealing rings is an O-ring, which is partly trapped in an annular groove 16, which is of trapezoidal cross section. As shown in FIGS. 1 and 3, two such rings are provided in axial-spaced relation along the frustoconical portion of the cover, a further ring 15 between the flange 6 and the shoulder 7 and still another O-ring 18 between the shoulder 17 and an end face 4*a* of the cover.

The interior of the vessel, after filling, receives a control gas which normally is excluded from the compartments 21 formed between the seals.

The flange 6 is overhung by a peripheral portion 19 of the cover 8. This peripheral portion having another annular groove, receives an O-ring 20 which rests upon a shoulder 19*a*, flush with the top of the plug 6. Another control compartment 21 is provided between the O-rings 15 and 20. Passages 22 in the container wall run from a quick connect fitting 22*a* to the individual compartments 21 and can be coupled by the fitting to a gas closure 23 which monitors the security of the seal. Naturally, each of the compartments 21 can be connected by separate passage 22 to a separate fitting 22*a*, with the fittings monitored successively from the inner compartments to the outermost to ascertain whether any of the seals has leaked.

In place of the O-ring between the flange 6 and the wall 2 and especially between the peripheral portion 19 and the shoulder 19*a*, a lip tight seal can be provided with welds 30 and 40, sealing the lips 31 and 32 and 41 and 42, which are set off by annular grooves. The advantages described in Ser. No. 966,951 are thereby gained here as well.

We claim:

1. A radiation shielding transport and storage vessel comprising:

a cast metal upright receptacle having a wall surrounding a space adapted to receive radioactive material and a bottom unitary with said wall, said space opening at the top of said vessel in a recess;

a plug-type radiation-shielding cover received in said recess and complementarily fitting said space, whereby said recess and said cover have complementary and confronting surfaces;

a plurality of annular seals disposed between and bridging said surfaces so as to define at least one control compartment between;

means forming at least one passage accessible from outside the vessel and communicating with said control compartment for monitoring a control gas in said vessel; and a safety cover overlying said plug cover and peripherally overhanging same while being recessed in said receptacle.

2. The vessel defined in claim 1 wherein a seal is provided between a rim of said safety cover and said receptacle outwardly of said plug-type cover and defines a further control compartment with a seal between said surfaces, said further control compartment being connected to a gas passage.

3. The vessel defined in claim 2 wherein said surfaces are frustoconical and downwardly tapered.

4. The vessel defined in claim 3 wherein a plurality of O-rings are provided along said surfaces in axial spaced relation to form respective seals defining respective compartments between them.

5. The vessel defined in claim 4 wherein said plug-type cover is provided with an end portion juxtaposed with a shield of said wall at the bottom of said recess, a respective O-ring being provided between said shoulder and said end portion.

6. The vessel defined in claim 5 wherein said plug-type cover is provided with an outwardly extending flange, juxtaposed with a ledge of said wall at the top of said recess, said ledge and said flange having an O-ring interposed between them.

7. The vessel defined in claim 5 or claim 6, wherein each of said O-rings is received in a respective groove formed in said plug-type cover.

* * * * *